United States Patent [19]

Tholander et al.

[11] Patent Number: 4,676,442

[45] Date of Patent: Jun. 30, 1987

[54] YARN ACCUMULATION AND FEEDING APPARATUS

[75] Inventors: Lars H. G. Tholander, Huskvarna; Anton P. Kerff, Ulricehamn, both of Sweden

[73] Assignee: Aktiebolaget IRO, Ulricehamn, Sweden

[21] Appl. No.: 765,905

[22] Filed: Aug. 14, 1985

[30] Foreign Application Priority Data

| | | | |
|---|---|---|---|
| Aug. 16, 1984 | [SE] | Sweden | 84041128 |
| Aug. 22, 1984 | [SE] | Sweden | 84041797 |
| Sep. 18, 1984 | [DE] | Fed. Rep. of Germany | 3434257 |
| May 9, 1985 | [EP] | European Pat. Off. | 85105703.4 |

[51] Int. Cl.[4] ..... B65H 51/20; B65H 51/30

[52] U.S. Cl. ..... 242/47.01; 242/36; 242/49

[58] Field of Search ..... 242/47.01, 47.12, 47.13, 242/49, 36, 37 R, 38; 139/452; 66/132 R, 132 T; 200/61.15, 61.13

[56] References Cited

U.S. PATENT DOCUMENTS

| | | | |
|---|---|---|---|
| 3,225,446 | 12/1965 | Sarfati et al. | 242/47.01 X |
| 3,490,710 | 1/1970 | Muhlhausler | 242/47.01 |
| 3,720,384 | 3/1973 | Rosen | 242/47.01 |
| 3,796,386 | 3/1974 | Tannert | 242/47.01 X |
| 4,092,006 | 5/1978 | Jacobsson | 242/47.01 |
| 4,180,215 | 12/1979 | Nurk | 242/47.01 |
| 4,298,172 | 11/1981 | Hellstrom | 242/47.01 |

FOREIGN PATENT DOCUMENTS

| | | | |
|---|---|---|---|
| 11468 | 1/1983 | Japan | 242/47.01 |

*Primary Examiner*—Stanley N. Gilreath

*Attorney, Agent, or Firm*—Flynn, Thiel, Boutell & Tanis

[57] ABSTRACT

A yarn accumulating and feeding apparatus (1) has a stationary accumulating drum adapted to have a yarn (27) formed into a yarn supply (26) thereon, the magnitude of which is monitored between a minimum and a maximum by means of at least one mechanical probe element (28,28',28'',28''',28'''') adapted to be displaced by the yarn supply between two positions (I,II) and operatively associated with a switching device located outside of the accumulating drum. The probe element is mounted in the accumulating drum for displacement between one position projecting past the surface of the accumulating drum, and another position extending flush with the accumulating drum surface (15) against the bias of a return force, while a switching device contains a sensor element (20,20',21,21',20'',20''') for generating a reaction signal in response to displacement of the probe element but without contacting the probe element.

28 Claims, 21 Drawing Figures

1
2
3
4
5
6
7
8
9
10
11
12
13
14
15
16
17
18
19
20
21
22
23
24
25
26
27
27

YARN ACCUMULATION AND FEEDING APPARATUS

FIELD OF THE INVENTION

The present invention relates to a yarn accumulation and feeding apparatus.

BACKGROUND OF THE INVENTION

In a yarn accumulation and feeding apparatus of the type to which the invention relates, a switching means serves for controlling the drive responsible for the replenishment of the yarn supply. As the magnitude of the yarn supply decreases to a minimum, the yarn supply is again increased, eventually up to a maximum magnitude, whereupon the drive is again deactivated. The control process may also be accomplished in such a manner that the replenishment of the yarn supply is carried out so as to keep the latter between its maximum and minimum values without actually attaining one of these values. If in this case the magnitude of the yarn supply attains either its maximum or its minimum value, this is taken as an indication of a disorder and results in the switching device deactivating the drive not only of the yarn accumulation and feeding apparatus, but also of associated machinery cooperating therewith. Yarn accumulation and feeding devices with a stationary accumulating body usually employ a finger-shaped probe element secured outside of the accumulating body and having one of its ends projecting into an axial recess of the accumulating body under the bias of a spring. The probe element either cooperates with a switching device or is itself provided with contacts for generating a signal in cooperation with complementary contacts. As the yarn supply grows to a certain magnitude, the probe element is deflected, resulting in the generation of a signal for interrupting the further increase of the yarn supply. This known apparatus suffers from the disadvantage that the probe element exerts a certain force on the yarn windings, resulting in a perceptible jerk on the withdrawal of each winding. In the yarn processing or textile industry it is essential, however, that the tension of the supplied yarn not only be very low, but also be substantially constant, which is the main object of the yarn accumulating and feeding device. As the yarn is being withdrawn, it should form a so-called balloon, which is prevented, however, by the exteriorly located probe element. It is further disadvantageous that the probe element, or its spring bias, has to be adjusted in conformity to the type and properties of the yarn to be fed as well as in conformity to the thickness of the yarn, which requires a rather complicated structure. These circumstances led to the increasing use of optical or optoelectronical sensing devices capable of scanning the yarn supply without actually contacting it. In one of these devices, a light beam is directed onto a stationary reflecting surface on the accumulating body so as to be reflected thereby, the reflected beam being then monitored as to its intensity or the like. It is very difficult, however, to consistently generate a strong and significant signal capable of being so monitored.

It is therefore an object of the present invention to provide a yarn accumulating and feeding apparatus of the type defined above in which the control or monitoring of the magnitude of the yarn supply is accomplished without interfering with the yarn withdrawal from the accumulating body.

SUMMARY OF THE INVENTION

This object is attained according to the invention by providing a yarn feeding apparatus in which the probe element is supported on the accumulating body for displacement between a first position projecting outwardly past the accumulating body surface and a second position extending flush with or disposed inwardly of the accumulating body surface, in which the probe element is biased toward its first position, and in which a sensor element generates a reaction signal in response to displacement of the probe element between its two positions without contacting the probe element.

These characteristics provide for the use of an extermely lightweight and easily displaceable probe element which is not subject in operation to contamination and offers the advantage that it does not noticably interfere with the withdrawal and advance of the yarn, because in the one position, in which the probe element projects from the surface of the accumulating body, the yarn is lifted off the surface of the accumulating body and over the probe element, or is lifted off the surface of the accumulating body at a relatively great distance before reaching the probe element, while in the other position, the probe element extends flush with the surface of the accumulating body under a very weak biasing force, or is even retracted thereinto so as to be practically non-existent with regard to the yarn. The probe element does not directly actuate any contacts or switching devices, so that it exerts a barely noticeable force on the yarn. On the other hand, the sensor element responds to any displacement of the probe element without actually touching it and generates the reation signal indicative of the displacement of the probe element and thus of the yarn supply having grown too large or too small.

An advantageous embodiment includes a proximity initiator which responds for instance to any change in the field generated by itself to detect any displacement of the probe element and to generate the reaction signal. Commercially available proximity initiators are highly sensitive to positional changes and may therefore be located at a sufficient distance from the surface of the accumulating body so as not to interfere with the movements of the yarn. A proximity initiator of this type is additionally capable of ignoring other electrically or magnetically conductive elements not directly located in its scanning range.

In a further embodiment the probe element is a metal leaf spring which is of low weight and may be readily bent to any suitable shape while ensuring a consistent return biasing force and which is capable of being secured in a simple manner. In connection with the proximity initiator, this results in a reliable scanning unit of low weight and small space requirement.

There is another alternative expedient embodiment in which each displacement of the probe element results in a positional change of the magnetic field which is sensed by the sensor element as a change of the field strength to result in the generation of a signal.

A further important aspect involves the return movement of the probe element not being subjected to the action of any exterior forces, so that the return biasing force can be kept extremely weak, thus favouring unhampered displacement of the probe element from its one position to the other against the return biasing force. The yarn windings are thus acted on only by a negligibly small force, so that the yarn withdrawal tension or the advance movement of the yarn supply are not affected.

In a further advantageous embodiment, an axis about which the probe element pivots may be located relatively close to the surface of the accumulating body, so that the mass of the probe element and a permanent magnet therein is concentrated about this axis, whereby the probe element is readily displaceable. In this embodiment it is advantageous that the tilt movement results in a defined tilt movement of the permanent magnet's magnetic field, which is sensed by the sensor element as an abrupt and relative strong change of the strength of the magnetic field. In the case of the leaf spring the tilt axis for the respective end may be determined so as to result in a long lever arm requiring a weak force for the displacement of the respective end.

An alternative to this embodiment involves a bending spring capable of being constantly loaded with a consistently low resistance and offers the advantage that it may at the same time be employed for securing the probe element in position in the accumulating body.

A further advantageous alternative embodiment involves a tension spring which assumes the role of the bending spring and causes the probe element to be returned to the position in which it projects from the surface of the accumulating element when the sensing range has been relieved of the yarn supply.

In a further advantageous embodiment the probe element is biased in the return direction not by a mechanical force, but rather by a magnetic force, which may readily be accomplisehd in such a manner that the initial force required for displacing the probe element from its one position is very weak, with a correspondingly advantageous effect with regard to the yarn windings.

In a further embodiment the yarn windings cause the probe element to be displaced in a linear direction, the resulting weakening of a magnetic field strength being sensed by the sensor element to result in the generation of a signal. The probe element may advantageously be housed within a small opening in the accumulating body which may readily be protected against contamination.

In a further alternative embodiment there is no definite tilt axis of the probe element within the accumulation body. The probe element is instead retained by the return biasing force in a state of unstable equilibrium from which it may be displaced by the action of the yarn windings to another state of likewise stable equilibrium. An oval shape of the probe element ensures that the probe element, when in its second position, does not project from the surface of the accumulating body.

As an alternative, a is provided in a guide path so that the probe element does, or does not, respectively, project from the surface in its two positions.

In this context it is advantageous to apply provisions which ensure that the end positions of the probe element are clearly defined from the outset, as in turn is the position of the permanent magnet's magnetic field which is to be accurately sensed by the sensor element.

A further aspect involves ensuring that the yarn windings are capable of readily displacing the probe element from one position to the other.

A hall effect sensor element can be used and is capable of sensing very small changes in the strength of the magnetic field.

A further and particularly advantageous embodiment orients the respective polarity of each of two permanent magnets so that a tilt element is constrained to follow any tilt movement of the probe element. The tilt element can be readily designed for effectively actuating a switching device or for cooperating with a contamination-protected opto-electronic switch element, of which the probe element itself is of course not capable. The probe element merely supplies a magnetic pulse to cause the tilt element to be displaced for the generation of a signal.

A separate return spring or a separate permanent magnet for effecting the return of the probe element can be eliminated if the magnetic interaction between the permanent magnets of the probe element and of the tilt element are utilized for generating the return force for the two members.

A further embodiment involves a probe element which is of a simple shape for low-cost manufacture, while its positioning in the accumulating body is facilitated and a quick response to any contact with a yarn winding is ensured. The intrusion of dirt, which might affect the operation of the probe element, can be effectively prevented.

A further embodiment offers the advantage of being substantially maintenance-free, when the recess housing the probe element is hermetically sealed with respect to the exterior, so that the operation of the probe element cannot be affected by contamination. A further embodiment has two probe elements and each probe element monitors a respective limit of the yarn supply for generating two different signals which may be processed as analog or digital signals for the control of other components.

In a structurally simple embodiment both probe elements are formed by a single leaf spring. In a further advantageous embodiment the displacement of the probe element is utilized for deflecting a light beam directed thereonto by an external light source. In contrast to conventional optical scanning systems, this offers the advantage that a very strong light beam may be employed and that the deflection of the light beam results in a very strong signal, as the receiver does not as formerly have to detect changes of the intensity of a reflected light beam, which may be relatively weak for several reasons, but merely differentiates between the presence and the absence of a strong reflected light beam. For this reason the optical scanning system is substantially more sensitive and reliable than formerly known ones.

A further important aspect involves the receiver being positioned at a location along the path taken by the light beam on displacement of the probe element. At one point of the displacement of the probe element the light beam impinges on the receiver, and does not so impinge during the remainder of the displacement. The signal generated in this manner is significant and strong.

In an alternative embodiment the light beam impinges on the receiver in one of the two positions between which the probe element is displaced. When the probe element is displaced from the respective position, the reflected light beam does no longer impinge on the receiver, giving a clear indication of such displacement.

According to a further provision, the direction in which the light beam is reflected by the probe element may be chosen to result in optimum control conditions so that the designer of the apparatus is free to determine the arrangement of the various cooperating components within a wide range.

BRIEF DESCRIPTION OF THE DRAWINGS

Embodiments of the invention shall now be described by way of example with reference to the accompanying drawings, wherein.

DETAILED DESCRIPTION

Figure 1:
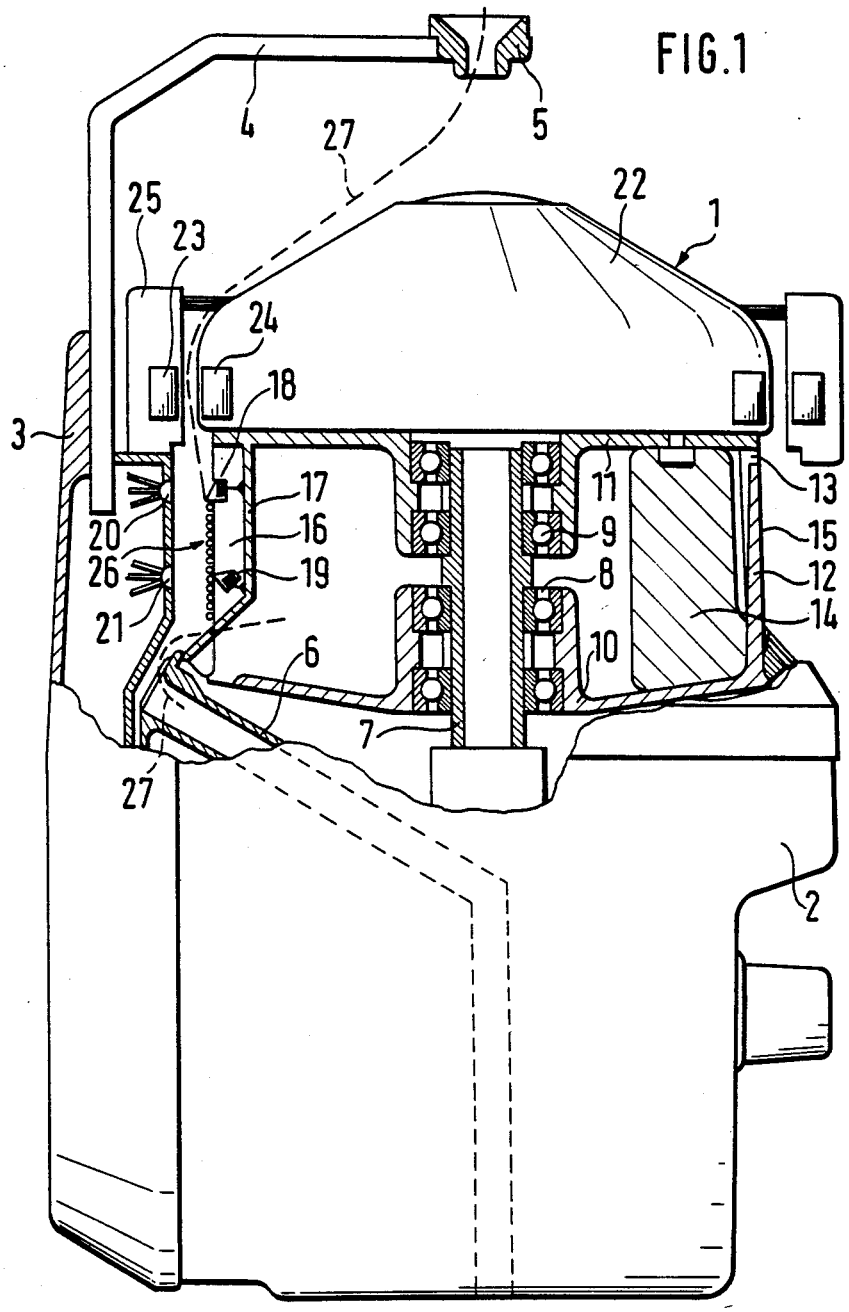
FIG. 1 shows a partially sectioned sideview of a yarn accumulating and feeding apparatus having a maximum probe element and a minimum probe element for monitoring the magnitude of the yarn supply.

Shown in FIG. 1 is a diagrammatic and partially sectioned sideview of a yarn accumulating and feeding apparatus 1 having a housing base portion 2 and a support arm 3 supporting a carrier 4 with a yarn withdrawal eyelet 5 thereon. Housing base portion 2 contains a drive source (not shown) for a tubular yarn winder element 6 rotating in unison with a drive shaft 7 extending in the axial direction of apparatus 1. Mounted on drive shaft 7 at separate mounting positions 8 and 9 having oppositely inclined axes of rotation (not shown) are two halves 10 and 11 of a drum-shaped accumulating body carrying mutually interspersed rods 12 and 13, respectively, defining an approximately cylindrical surface 15 of the accumulating body. The angular offset of the axes of rotation, possibly in combination with a likewise not shown excentricity of the axes of rotation of the two halves 10 and 11, results in drive shaft 7 imparting an axial advancing movement away from winding element 6 to a yarn supply 26 supported on surface 15.

A yarn designated 27 is supplied through yarn winder element 6 and wound onto surface 15 in a tangential direction so as to form the windings of yarn supply 26, from which the yarn is subsequently withdrawn over a head portion 22 of the accumulating body and through eyelet 5.

Located in a longitudinally extending recess 16 of the accumulating body defined by a wall 17 are a maximum probe element 18 and a minimum probe element 19 operable to determine the magnitude of yarn supply 26. Sensor elements 20 and 21 spaced from and directed towards probe elements 18 and 19 serve for sensing the actual position of the respective probe element and for generating corresponding signals employed for instance for energizing or deenergizing the drive motor in housing base portion 2 so as to wind more yarn onto accumulating body surface 15 for increasing the yarn supply 26 thereon or to discontinue the winding of the yarn, respectively.

In order to prevent the accumulating body from rotating in unison with drive shaft 7, head portion 22 contains a magnet 24 facing a further magnet 23 supported in a carrier ring 25. The interaction between magnets 23 and 24 results in a retaining force holding the accumulating body stationary, so that drive shaft 7 rotates therewithin and relative thereto, whereby the two halves 10 and 11 of the accumulating body are constrained to carry out their yarn advancing movements. The accumulating body further contains a filler body 14 for preventing contaminations from entering the accumulating body and infiltrating bearing portions 8 and 9.

The yarn supply 26 should be of a certain axial length or magnitude, which is subject, however, to change in response to the winding up of further yarn by the yarn winder element 6 and to the withdrawal of yarn through eyelet 5. The magnitude of the yarn supply may thus vary between a maximum and a minimum, both of which should not be exceeded. In FIG. 1 the minimum probe 19 is thus actuated to indicate that the yarn supply is greater than the minimum value, while the maximum probe 19 is not actuated, indicating that the yarn supply 26 is correctly smaller than the maximum value.

Figure 2A:
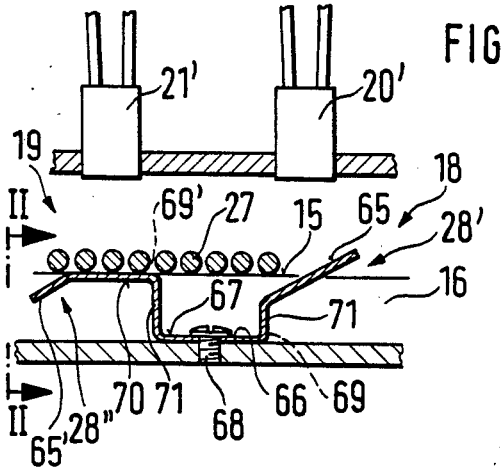
FIG. 2A shows a first variation of a minimum and maximum probe element according to FIG. 1.
Figure 2B:
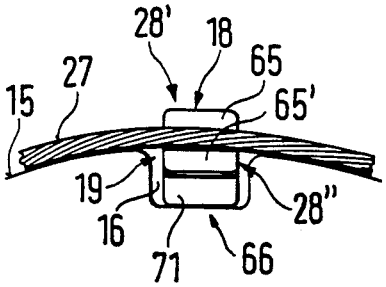
FIG. 2B shows a sectional view taken along the line II—II.

In the embodiment of FIGS. 2A and 2B the maximum and minimum probes 18, 19 are formed by the two ends 65, 65' of a single metal leaf spring 66. Leaf spring 66 has a flat base portion 67 releasably secured in recess 16 by means of a screw 68. Vertical legs 71 rise from base portion 67 towards accumulating body surface 15 and terminate in outwardly bent end portions 65, 65' devised so as to project above surface 15 in the absence of yarn windings 27 resting thereon. End portion 65' is angularly connected to an intermediate portion 70 in such a manner that in the relaxed state it does not fully project from surface 15 so as to form an inclined ramp for the windings 27 to run up on, while in its loaded state it is depressed about a tilt axis 69' and into the recess (FIG. 2A) so that intermediate portion 70 lies approximately flush with surface 15. The tilt axis 69' of end portion 65' might also be located at the lower end of rear leg 71 at its junction with base portion 67. The tilt axis 69 of the other end portion 65 may be situated either—as shown—at the junction of righthand leg 71 with base member 67 or at the junction of end portion 65 with leg 71. The sensor elements 20', 21' are proximity initiators generating an electromagnetic or eddy current field which is affected by displacements of the electrically conductive probe elements 28', 28" for the generation of a signal. Proximity initiators of this type are commercially available in various models of different sensitivity. They are capable of operating satisfactorily even in the presence of other metallic elements. The correct operation of the two initiators 20',21' is therefore not affected by the integral construction of leaf spring 66. It is of course also possible, however, to employ separate leaf springs for the two probe elements 28' and 28''.

Figure 3A:
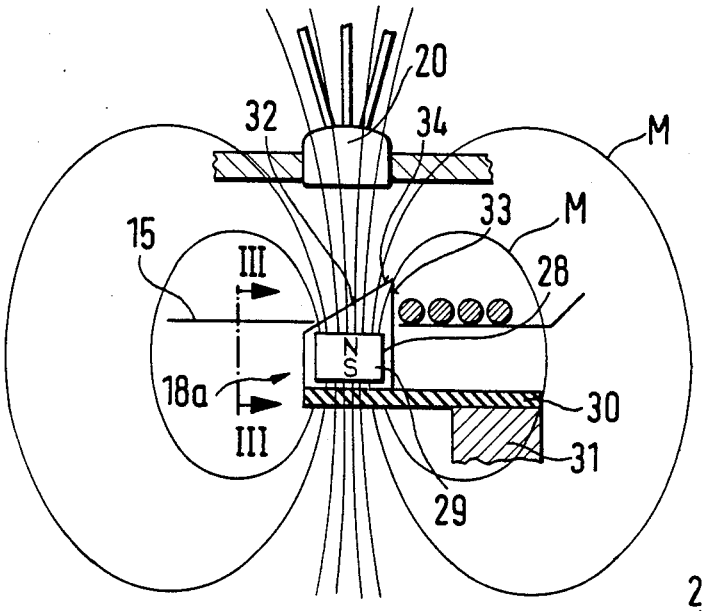
FIG 3A shows a second modification of a minimum probe element according to FIG. 1.
Figure 3B:
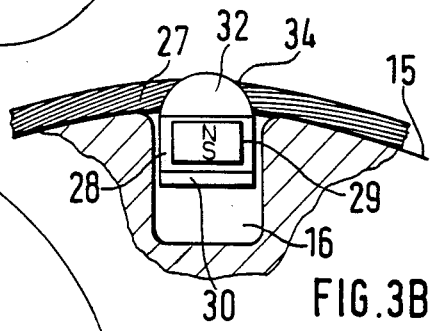
FIG. 3B shows a sectional view taken along the line III—III in FIG. 3A.
Figure 3C:
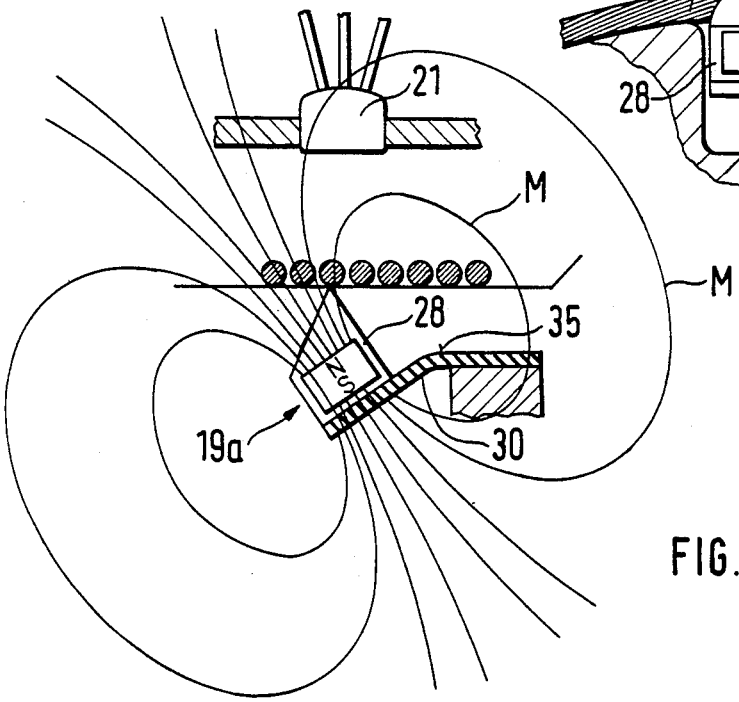
FIG. 3C is a view similar to FIG. 3A but showing a different position of operation.

In the embodiment of FIGS. 3A to 3C, the maximum and minimum probes each comprise a block-shaped probe element 28 enclosing a permanent magnet 29 at a predetermined polarity and mounted on a bending spring 30 itself secured to a counterbearing 31. Bending spring 30 may be formed of soft rubber or an elastomer so as to yield about a flexure point 35 when probe element 28 is depressed by the windings of the yarn supply. In FIG. 1 the probe elements are supported on bending springs extending approximately radially with respect to the axis of the apparatus 1, whereas in the embodiment of FIGS. 3A to 3C they are mounted on substantially axially extending bending springs 30. Each bending spring is at the same time effective to ensure the positioning of its respective probe element 28 in its two positions. In one of these positions, assumed under the return biasing action of bending spring 30, a wedge-shaped tip 34 of probe element 28 defined by a substantially vertical face 33 and an inclined ramp 32 projects above the accumulating body surface by a distance substantially corresponding to the yarn diameter. In the other position (FIG. 3C) spring 30 is bent off and tip 34 of probe element 28 is substantially flush with surface 15 so as to enable the windings of yarn supply 26 to slide forwards substantially without resistance.

As shown in FIG. 3B, probe element 28 is disposed in recess 16 in a close lateral fit. The wedge-shaped tip 34 has a convex contour. The permanent magnet 29 is suitably arranged in the manner shown in FIG. 3A, so that the magnetic force lines M at the center of its magnetic field are directed straight onto sensor element 20, the latter being preferably a Hall element which is immediately responsive to changes in the strength of the magnetic field for effecting the generation of a signal.

In the position of probe element 28 shown in FIG. 3C, the magnetic field, i.e. the magnetic force lines M is obviously tilted sidewards, so that sensor element 21 of minimum probe **19*a* receives a reduced portion of the magnetic field as compared to the position shown in FIG. 3A. In this manner sensor element 20 or 21 may generate a signal in response to the downward displacement of probe element 28**, in response to its return movement, or in both cases.

Figure 4B:
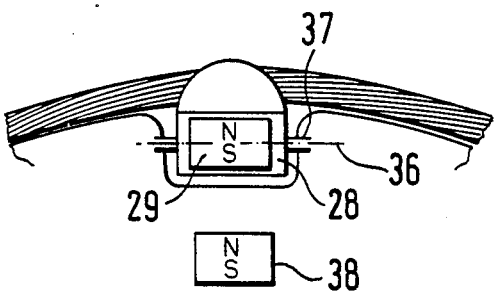
FIGS. 4A and 4B show corresponding views of a further embodiment of the minimum probe element of FIG. 1.
Figure 4A:
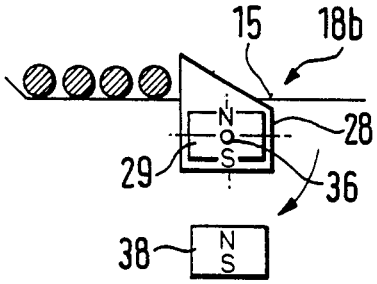

In the embodiment of minimum probe 18i b shown in FIGS. 4A and 4B, there is again provided a block-shaped probe element 28 integrally including a permanent magnet 29 and mounted in a bearing portion 37 of the accumulating body for tilting displacement about an axis 36 extending substantially parallel to the yarn windings. Axis 36 is suitably located adjacent the center of gravity of probe element 28 including permanent magnet 29, so that tilting of the probe element requires only a relatively weak force. It would also be possible to locate axis 36 directly at the center of gravity. In this embodiment, the return biasing force for returning probe element 28 from its downwards tilted position to the position shown in FIG. 4A is generated by a further permanent magnet 38 disposed within the accumulating body with its polarity opposite to that of permanent magnet 29 of probe element 28. The interaction between magnets 29 and 38 thus results in probe element 28 being returned to its position shown in FIG. 4A as soon as the load exerted thereon by the yarn windings is removed.

Figure 5B:
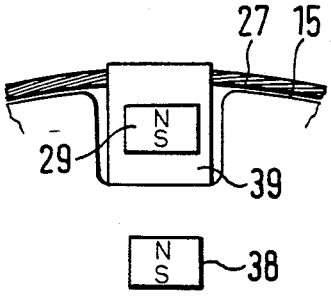
FIG. 5B shows a view of the maximum probe element of FIG. 5A rotated by 90°
Figure 5A:
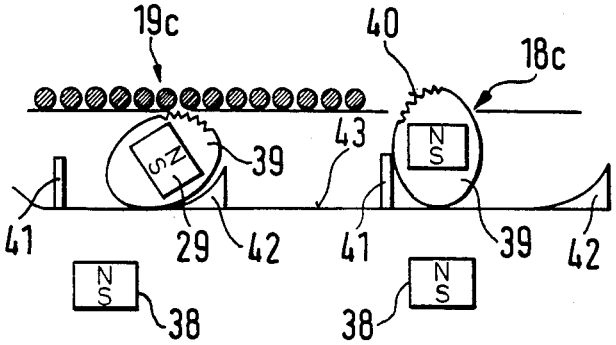
FIG. 5A shows a further embodiment of the two probe elements.

In the embodiment of FIGS. 5A and 5B, minimum and maximum probes **18*c*, 19*c* each comprise an oval disk-shaped probe element 39 having a permanent magnet 29 located at its center. The return biasing force for each probe element 39 is generated by a further permanent magnet 38 with oppositely directed polarity. As shown in FIG. 5B, each probe element 39 is of relatively large width, enabling it to smoothly run on an axially extending guide path 43 formed within recess 16 of the accumulating body. Permanent magnet 38 causes probe element 39 to assume an upright position in which a structured or roughened surface portion, for instance transversely grooved surface portion 40, projects past accumulating body surface 15 for engagement with yarn 27 windings, as a result of which probe element 39 of for instance minimum probe 19*a* is turned sideways to a position in which surface portion 40 lies flush with accumulating body surface 15. Guide path 43 may be provided with stop members 41 and 42** for positively defining the two end positions of each probe element.

Figure 6B:
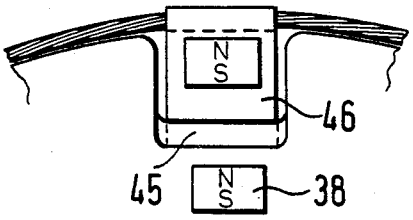
FIGS. 6A and 6B show corresponding views of a further embodiment of a probe element.
Figure 6A:
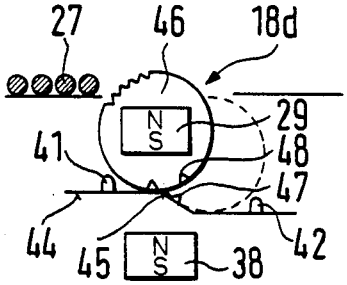

In the embodiment of minimum probe **18*d* shown in FIGS. 6A and 6B, a probe element 46 is provided in the form of a circular disk of a certain width having a permanent magnet 29 integrally included therein. The accumulating body is formed with a guide path 44 having a step 45, along which probe element 46 is displaceable in such a manner that in one of its positions it projects from surface 15, while in the other position (shown in dotted lines) it extends flush with surface 15. The return biasing force for returning probe element 46 from its retracted to its projecting position is generated by a second permanent magnet 38. Guide path 44 is again formed with stops 41 and 42 for positively determining the two end positions of probe element 46. Probe element 46 may in addition be formed with notches 48 cooperating with teeth 47 on guide path 44 in such a manner that probe element 46 is prevented from rotating relative to guide path 44**.

In a modification of this embodiment, probe element 46 may of course be of spherical configuration.

In the above described embodiments it would also be possible to replace second permanent magnet 38 by a spring for generating the return biasing force for the probe element.

Figure 7B:
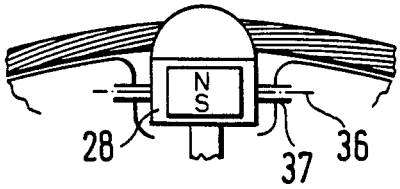
FIGS. 7A and 7B show corresponding views of a still further embodiment of a probe element.
Figure 7A:
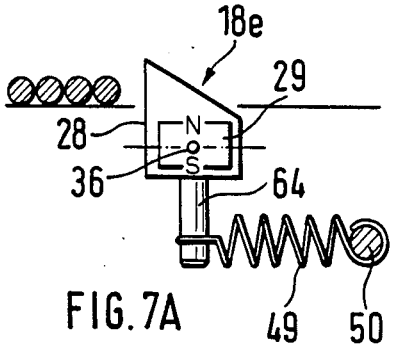

The embodiment of minimum probe **18*e* shown in FIGS. 7A and 7B again comprises a block-shaped probe element 28 integrally including a permanent magnet 29 and mounted in bearing portions 37 of the accumulating body for tilting displacement about an axis 36. Projecting from the bottom surface of probe element 28 is a pin 64 engaged by a tension spring 49, the other end of which is anchored to a stationary mounting pin 50 in the accumulating body. Tension spring 49 generates the return biasing force for probe element 28. The accumulating body is suitably provided with stop means (not shown) for positively defining the end position of probe member 28 as shown in FIG. 7A**.

Figure 8:
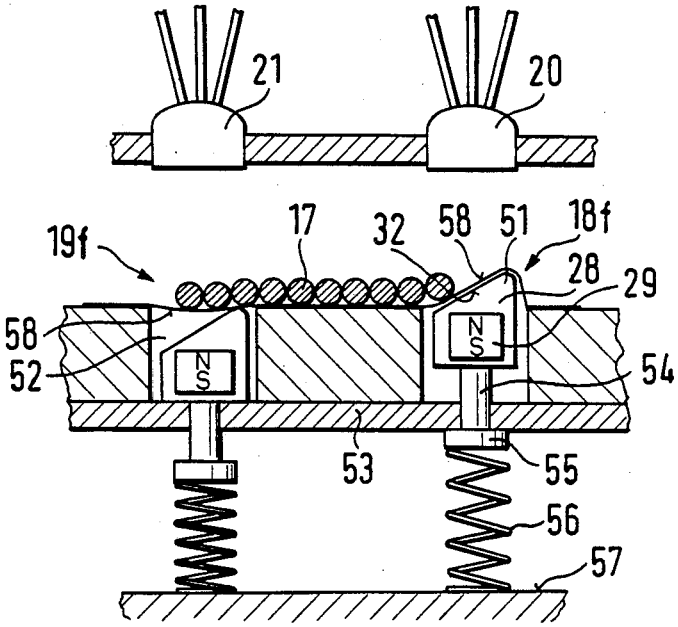
FIG. 8 shows a further embodiment of the two probe elements of FIG. 1, FIGS. 9A and 9B show corresponding views of still another embodiment of the maximum probe element of FIG. 1.

In the embodiment shown in FIG. 8, minimum and maximum probes **19*f*, 18*f* again each comprise a block-shaped probe element 28 at a position, however, rotated by 180° with respect to the advancing movement of the windings of yarn 27 and to the position shown in the previously described embodiments, so that its inclined ramp surface 32 is directed opposite to the advancing movement. The tip of each probe element 28 is additionally rounded as shown at 51**.

Both probe elements 28 are mounted in radially extending cavities 52 of the accumulating body for radial displacement with the aid of push rods 54 slidably guided in a retainer plate 53. Below retainer plate 53 each push rod 54 is formed with an enlarged head portion 55 for engagement by a compression spring 56, the other end of which is supported on a support surface 57. Cavities 52 are sealed with respect to the exterior by a thin skin 58.

In FIG. 8, minimum probe 19*f* has been depressed by the yarn supply to such a degree that its tip 51 extends substantially flush with surface 15 and head portion 55 is disengaged from retainer plate 53. On the other hand, probe element 28 of maximum probe 18*f* is biased by compression spring 56 to a position in which head portion 55 engages retainer plate 53 and inclined ramp 32 projects past surface 15, so that skin 58 is extended upwards.

Sensor elements 20 and 21 are in the form of Hall elements responsive to changes in the strength of the magnetic field caused by displacements of probe elements 28.

Figure 9B:
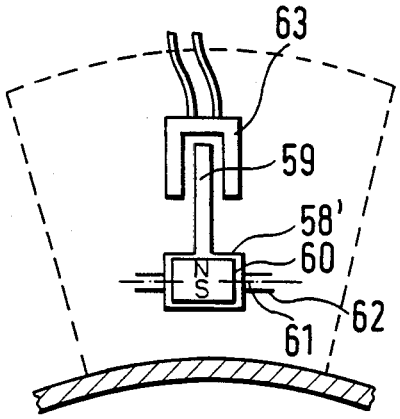
Figure 9B:
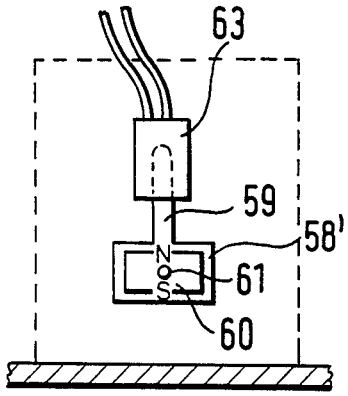
Figure 9B:
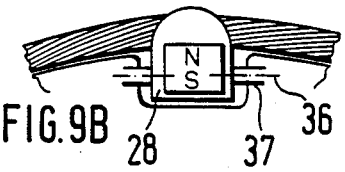
Figure 9A:
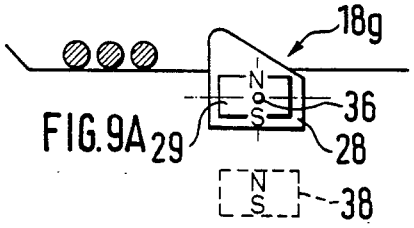

The embodiment shown in FIGS. 9A and 9B again comprises a block-shaped probe element 28 integrally including a permanent magnet 29 and mounted in bearing portions 37 of the accumulating body for tilting movement about axis 36. Although in FIG. 9A there is shown a further permanent magnet 38 which may be provided for generating the return biasing force, this second permanent magnet is not necessarily required in this embodiment.

This is because the sensor element aligned with probe element 28 is a tilt element 58' integrally incorporating a permanent magnet 60 at the same polarity arrangement as permanent magnet 29 of probe element 28. Tilt element 58' is provided with an upstanding arm 59 cooperating with an opto-electronic sensor 63. Tilt element 58' is mounted in a bearing portion 62 for tilting movement about an axis 61 parallel to axis 36.

Figure 10:
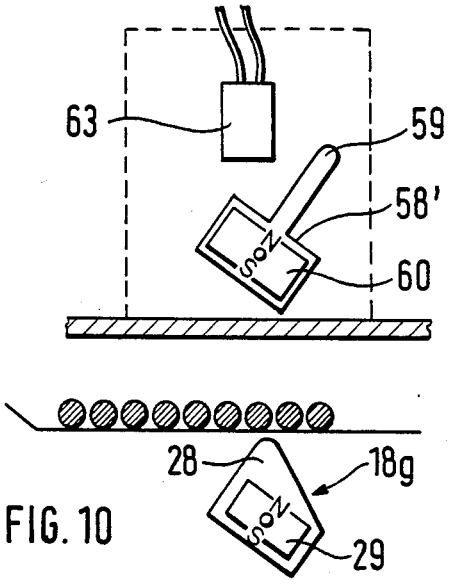
FIG. 10 shows the maximum probe element of FIGS. 9A and 9B at a tilted position.

The two permanent magnets 29 and 60 attract one another and cooperate in such a manner that a tilting displacement of probe element 28 (FIG. 10) of minimum probe 18*g* causes tilt element 58' with its permanent magnet 60 to be correspondingly tilted about axis 61, as the magnetic force lines of the two magnets tend to remain in parallel alignment, whereby arm 59 is disengaged from opto-electronic sensor 63 for the generation of a signal. Due to the interaction of the two magnets 29 and 60 they tend to simultaneously return to the position shown in FIG. 9A as soon as the force which is tilting prove element 28 disappears.

Figure 11A:
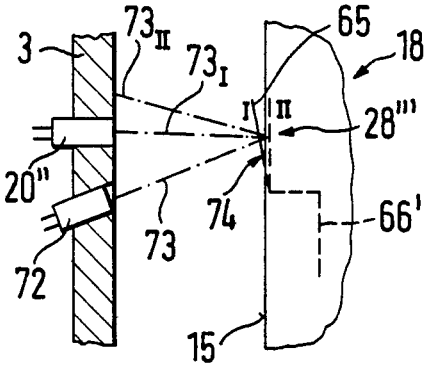
FIGS. 11A to 11C show three further embodiments of a maximum probe element in an optical monitoring system.
Figure 11B:
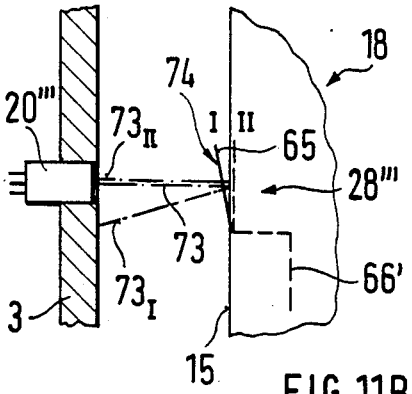
Figure 11C:
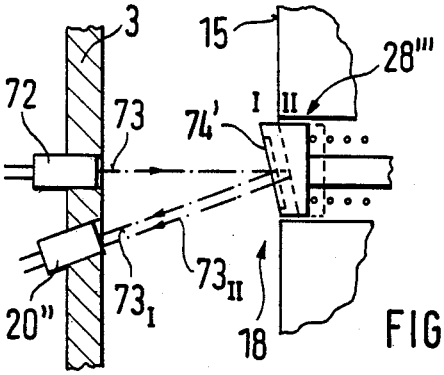

FIGS. 11A to 11C show embodiments of an optical system as applied to a maximum probe 18.

In FIG. 11A maximum probe 18 comprises a probe element 28''' formed by a resilient end portion 65 of a leaf spring 66' secured below the surface 15 of the accumulating body in a not shown manner. In the relaxed state I, end portion 65 projects obliquely above surface 15, while under loading by the yarn windings it assumes a position II substantially flush with surface 15. End portion 65 is provided with a reflecting surface 74, for instance a mirror surface. Disposed in a stationary portion of the apparatus is a sensor element 20'' in the form of a photosensitive element, e.g. a phototransistor, in association with a light source 72, for instance a photodiode. Light source 73 emits a light beam 73, for instance an infrared light beam, directed onto reflecting surface 74 of end portion 65 so as to be reflected in a direction 73 I in the position I of probe element 28'''. Sensor element 20'' is aligned with the direction 73 I of the reflected light beam. When end portion 65 is displaced by the yarn windings to the position II, light beam 73 is reflected in a direction 73 II so that it no longer impinges on sensor element 20''.

In the embodiment of FIG. 11B, light source 72 is integrally incorporated into sensor element 20''', which in this case thus contains a receiver for the light beam 73 in addition to the light source. The light source of sensor element 20''' emits a light beam 73 substantially radially of the accumulating body and thus perpendicular to the surface 15 thereof. In the position I of end portion 65 light beam 73 is reflected in a direction 73 I in which it does not impinge on sensor element 20'''. When end portion 65 is displaced, however, to the position II, in which it is substantially flush with surface 15, light beam 73 is reflected in a radial direction 73 II perpendicular to surface 15 so as to fully impinge on sensor element 20'''. Probe element 28''', which in this case is again employed for the maximum probe 18, is thus used for signal generation in its second position II, in which light beam 73 is reflected in the direction 73 II onto sensor element 20'''.

In the embodiment of FIG. 11C, probe element 28''' is in the form of a block mounted for radial displacement relative to accumulating body surface 15 and having an inclined ramp surface 74' for the yarn windings to ride up on, ramp surface 74' being either reflective by itself or provided with a reflective insert. Probe element 28''' again forms part of a maximum probe 18. Mounted in a stationary portion of the apparatus is a light source 72 emitting a light beam 73 directed onto surface 74' of probe element 28'''' in a radial direction substantially perpendicular to surface 15. In the position I of probe element 28'''', in which it projects from surface 15, light beam 73 is reflected in a direction 73 I, in which it impinges on sensor element 20'', the latter being again in the form of a photodiode or a light-responsive signal generator. In the position II, in which probe element 28'''' is substantially flush with surface 15, the reflected light beam is displaced downwards as shown in the drawing so as to extend in a direction 73 II, in which it does not impinge on sensor element 20''.

In the embodiments shown in FIGS. 11A to 11C, the light beam directed onto the probe element may practically be aligned in any direction, care having only to be taken that the reflected light beam impinges on the sensor element at a given position of the probe element while not impinging thereon in any other position of the probe element. In this context it is of no importance in what direction relative to surface 15 or to the axis of the accumulating body the probe element is to be displaced by the yarn windings, (either radially or about an axis extending parallel to the axis of the accumulating body or to the yarn windings), as long as it is ensured that the displacement of the probe element results in a corresponding displacement of the reflected light beam which can be sensed by the sensor element for the generation of a signal.

We claim:

1. A yarn accumulating and feeding apparatus, comprising: a stationary drum-shaped accumulating body having a surface on which yarn can be wound; winding means for winding a yarn onto said surface of said accumulating body so as to provide thereon a yarn supply consisting of a plurality of windings of yarn; monitoring means for monitoring the length of said yarn supply in a direction axially of said accumulating body to determine whether such length is between a predetermined minimum length and a predetermined maximum length, said monitoring means including at least one probe element supported at a location inwardly of said surface on said accumulating body for movement between a first position in which a portion thereof projects outwardly beyond said surface on said accumulating body and a second position in which said probe element is one of flush with and disposed inwardly of said surface of said accumulating body, and including biasing means for yieldably biasing said probe element toward said first position thereof, wherein when windings of said yarn supply are axially aligned with said portion of said probe element they engage and diplace said probe element from said first position to said second position against the urging of said biasing means, said monitoring means further including sensor means separate from, responsive to movement of and free of physical contact with said probe element for generating a reaction signal in response to displacements of said probe element between said first and second positions thereof; and means responsive to said reaction signal for causing said winding means to vary the number of windings of yarn present in said yarn supply.

2. A yarn accumulating and feeding apparatus according to claim 1, wherein said probe element includes a material which is one of electrically conductive and magnetically conductive, and wherein said sensor means includes proximity initiator means for generating one of a magnetic, electromagnetic and eddy current field in the region of said probe element and responsive to variations in said field caused by displacements of said probe element for generating said reaction signal.

3. A yarn accumulating and feeding apparatus according to claim 2, wherein said probe element is a metal leaf spring mounted on said accumulating body and said portion of said probe element is an end portion of said leaf spring which projects outwardly past said surface of said accumulating body in a relaxed state of said spring, said biasing means being an inherent resilience of said leaf spring.

4. A yarn accumulating and feeding apparatus according to claim 1, wherein said probe element includes a permanent magnet, and wherein said sensor means is disposed within a magnetic field produced by said magnet and is responsive to changes in the strength of said magnetic field caused by displacements of said probe element and permanent magnet for generating said reaction signal.

5. A yarn accumulating and feeding apparatus according to claim 4, wherein said biasing means imparts to said probe element a force which is only slightly greater than the minimum force needed to displace said probe element containing said permanent magnet from said second position to said first position.

6. A yarn accumulating and feeding apparatus according to claim 1, wherein said probe element is supported on said accumulating body for pivotal movement about a pivot axis which extends substantially parallel to a portion of the windings of said yarn supply located in the region of and engageable with said portion of said probe element.

7. A yarn accumulating and feeding apparatus according to claim 1, wherein said probe element is movably supported on a flexible element made of a rubber-like material, said biasing means being an inherent resilience of said flexible element.

8. A yarn accumulating and feeding apparatus according to claim 6, wherein said biasing means includes a tension spring which exerts on said probe element a biasing force at a location spaced radially from and in a direction substantially tangential to said pivot axis.

9. A yarn accumulating and feeding apparatus according to claim 4, wherein said biasing means includes a further permanent magnet which is supported on said accumulating body and which produces in the region of said probe element a further magnetic field which urges said first-mentioned magnet toward a position in which said probe element is in its first position.

10. A yarn accumulating and feeding apparatus according to claim 1, wherein said probe element has an inclined surface thereon which is said portion engageable by windings of said yarn supply, wherein said probe element moves between its first and second positions in directions radially of an axis of said accumulating body, and wherein said biasing means includes a compression spring which urges said probe element radially outwardly.

11. A yarn accumulating and feeding apparatus according to claim 1, wherein said probe element is an oval-shaped disk supported for rolling displacement on a guide surface provided on and extending axially of said accumulating body.

12. A yarn accumulating and feeding apparatus according to claim 11, wherein said guide surface has stops effective to stop said probe element at each of said first and second positions thereof.

13. A yarn accumulating and feeding apparatus according to claim 11, wherein said portion of said probe element has thereon a surface which is roughened.

14. A yarn accumulating and feeding apparatus according to claim 1, wherein said probe element is a round disk supported for rolling movement on a guide surface which is provided on said accumulating body and which has a step.

15. A yarn accumulating and feeding apparatus according to claim 14, wherein said guide surface has stops effective to stop said probe element at each of said first and second positions thereof.

16. A yarn accumulating and feeding apparatus according to claim 14, wherein said portion of said probe element has thereon a surface which is roughened.

17. A yarn accumulating and feeding apparatus according to claim 1, wherein said sensor means includes a Hall effect sensor aligned with said probe element.

18. A yarn accumulating and feeding apparatus according to claim 4, wherein said probe element is supported for pivotal movement about a pivot axis, wherein said sensor means includes a tilt element supported for pivotal movement about an axis extending parallel to said pivot axis of said probe element and having a further permanent magnet which is oriented to have substantially the same polarity as said first-mentioned permanent magnet of said probe element, said further magnet being responsive to the magnetic field of said first-mentioned magnet so as to cause tilting of said tilt element in response to and synchronously with tilting movements of said probe element, and switch means responsive to tilting movement of said tilt element for generating said reaction signal.

19. A yarn accumulating and feeding apparatus according to claim 18, wherein said biasing means includes said first-mentioned and further magnets being positioned so that the magnetic interaction therebetween urges said probe element toward its first position.

20. A yarn accumulating and feeding apparatus according to claim 4, wherein said probe element is in the form of a block having a wedge-shaped tip and is made of a plastic material in which said permanent magnet is embedded.

21. A yarn accumulating and feeding apparatus according to claim 1, wherein said probe element is disposed in a recess which is provided in said accumulating body and which conforms to the shape of said probe element.

22. A yarn accumulating and feeding apparatus according to claim 1, wherein said recess is sealingly covered by a thin diaphragm, said diaphragm being pressed outwardly by said probe element when said probe element is in its first position, and extending substantially flush with said surface on said accumulating body when said probe element is in its second position.

23. A yarn accumulating and feeding apparatus according to claim 1, wherein said monitoring means includes two of said probe elements which are spaced from each other in the axial direction of said accumulating body and which respectively monitor said minimum length and said maximum length of said yarn supply.

24. A yarn accumulating and feeding apparatus according to claim 23, wherein each said probe element is a respective end portion of a metal leaf spring which has been bent to a substantially U-shaped configuration having two legs with outwardly turned end portions.

25. A yarn accumulating and feeding apparatus according to claim 1, wherein said probe element has a light-reflecting surface, and wherein said sensor means includes one of an optical sensor and an opto-electronic sensor aligned with the direction of a light beam reflected by said probe element in a predetermined position of said probe element.

26. A yarn accumulating and feeding apparatus according to claim 25, wherein said sensor is aligned with a direction of said reflected light beam which occurs during displacement of said probe element between said first and second positions.

27. A yarn accumulating and feeding apparatus according to claim 25, wherein said sensor is aligned with the direction of the light beam reflected by said probe element in one of said first and second positions thereof.

28. A yarn accumulating and feeding apparatus according to claim 25, wherein said sensor means includes a light source supported at a fixed position outside of said accumulating body so as to direct its light beam onto said probe element.

* * * * *